US006410441B1

(12) United States Patent
Niu

(10) Patent No.: US 6,410,441 B1
(45) Date of Patent: Jun. 25, 2002

(54) AUTO SLURRY DELIVER FINE-TUNE SYSTEM FOR CHEMICAL-MECHANICAL-POLISHING PROCESS AND METHOD OF USING THE SYSTEM

(75) Inventor: Pao-Kang Niu, Hsin-Chu (TW)

(73) Assignee: Worldwide Semiconductor Manufacturing Corp. (TW)

( * ) Notice: Subject to any disclaimer, the term of this patent is extended or adjusted under 35 U.S.C. 154(b) by 0 days.

(21) Appl. No.: 09/458,827

(22) Filed: Dec. 13, 1999

(51) Int. Cl.[7] ..... H01L 21/302
(52) U.S. Cl. ..... 438/692
(58) Field of Search ..... 438/690, 691, 438/692, 693

(56) References Cited

U.S. PATENT DOCUMENTS 5,036,015 A * 7/1991 Sandhu et al. ..... 437/8
5,945,346 A * 8/1999 Vanell et al. ..... 438/691

* cited by examiner

*Primary Examiner*—Benjamin L. Utech
*Assistant Examiner*—Matthew Anderson

(57) ABSTRACT

An auto slurry deliver fine-tune system and a method using the system is discloses. A slurry flow system varies the flow rate of the slurry in a CMP system and the distance between the slurry injector and the polish head of the CMP system. A current detect system detects the current driving the turn-table of the CMP system. Moreover, a judgement system determines whether the current is minimum in order to determine that the flow rate and the distance are optima.

5 Claims, 3 Drawing Sheets

AUTO SLURRY DELIVER FINE-TUNE SYSTEM FOR CHEMICAL-MECHANICAL-POLISHING PROCESS AND METHOD OF USING THE SYSTEM

FIELD OF THE INVENTION

The present invention relates to an auto slurry deliver fine-tune system for chemical-mechanical-polishing process, more specifically, to an auto slurry deliver fine-tune system that is controlled by the turn-table current in chemical-mechanical-polishing process.

BACKGROUND OF THE INVENTION

Chemical-mechanical-polishing (CMP) process is indicated as a global planarization process for deep sub-micron integrated circuits. One or several wafers, which have polishing thin film layers, are put on a polish pad of a CMP system and the polished thin film layers touches the surface of the polish pad for planarizing the wafers. As the wafers are polished on the polish pad, polishing slurry is dispersed on the polish pad for performing a chemical reaction upon the polished layers in the chemical-mechanical polishing process.

A top view of a polish pad 100 in a CMP system is shown in FIG. 1 and two polish heads 200 for fixing and pressing the wafers, which are polished for global planarization, are put on the polish pad. During the CMP process, the polish pad 100 is rotated with respect to its central point and the polish head 200 is rotated with respect to its central axis. The cross-section view of the polish pad 100 is shown in FIG. 3 and the polish head 200 is rotated with respect to the central axis 201. Still referring to FIG. 3, an injector 300 is placed above the polish pad 100 for dispersing polishing slurry thereon. Noted that the flow rate that the slurry is injected out the injector 300 and the position of the injector 300 are critical factors to effect the remove rate in CMP process.

Since the manufacture of integrated circuits must be cost down, the amount of the slurry used in CMP system should be reduced. In other words, how to use minimum slurry in a CMP process becomes an important issue of the manufacture of integrated circuits. Nevertheless, when the amount of the slurry in a CMP process is reduced, the remove rate of the wafers be polished in the CMP process will be decreased because the chemical reaction upon the wafers is not very active.

In a CMP system, there are four independent process parameters for determining the remove rate of wafers that are polished in the system. The parameters includes the pressure pressing on the polish head of the system, the pressure pressing on wafers in the system, the rotated rate of the polish pad of the system and the rotated rate of the polish head. Generally, as the four independent parameters are decided, the maximum remove rate of the wafers is simultaneously decided.

In a CMP process, how to reduce the flow rate of the slurry in order to increase or sustain the remove rate of the wafers becomes an important issue. In other words, as the four independent factors are determined, the issue is to find the optima value of the flow rate of the slurry and the optima distance X between the central axis of the polish head and the injector for dispersing the slurry on the polish pad.

The chemical-mechanical-polishing (CMP) process is a new technology in IC industry today. Sometimes it does not need so much slurry to polish the wafer, because the best slurry flow position is not known, especially at some special rotated rate, so some slurry is always wasted. It is needed a method of how to monitor the friction between pad and wafer in line and to use current feedback to make some judgement to fine tune the injector position and the flow rate of slurry.

SUMMARY OF THE INVENTION

The present invention provides an auto slurry deliver fine-tune system, comprising: a slurry flow system to vary a flow rate of the slurry in a CMP system and the distance between a slurry injector and a polish head of the CMP system; a current detect system to detect the current driving the turn-table of the CMP system; a judgement system to determine whether the current is minimum in order to determine that the flow rate and the distance are optima.

The present invention provides a method of a slurry deliver fine tune in a chemical mechanical polishing (CMP) system, comprising: varying a flow rate of the slurry in the CMP system and the distance between a slurry injector and a polish head of the CMP system; detecting the current driving the turn-table of the CMP system; determining whether the current is minimum; varying the flow rate and the distance until the current reaches to minimum; sustaining the flow rate and the distance for the optima flow of the slurry.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses an auto slurry deliver fine-tune system for chemical-mechanical-polishing (CMP) process. The system includes a slurry flow system and a control system. The slurry flow system decides the optima flow rate of the slurry and the optima distance between the slurry injector and the polish head in order to get the maximum value of the remove rate of the CMP process. Moreover, the control system detects the current for driving the turn-table of the CMP system, as the factors of the flow rate of the slurry and the position and the slurry injector in the system are sustained. The current value is input into a judgement system, then, the factors including the flow rate and the position are varied in order to get the minimum current value. As the judgement system analyzes that the current reaches to a minimum value, the flow rate of slurry and the position of the slurry injector are optima.

Figure 1:
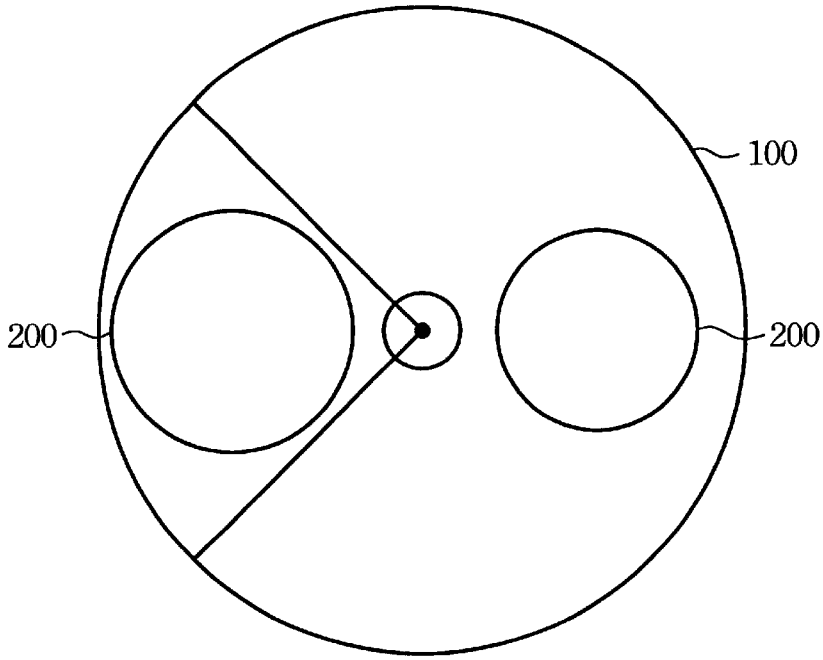
FIG. 1 shows a top view of a conventional polishing pad, wherein polishing heads put on the pad.
Figure 2:
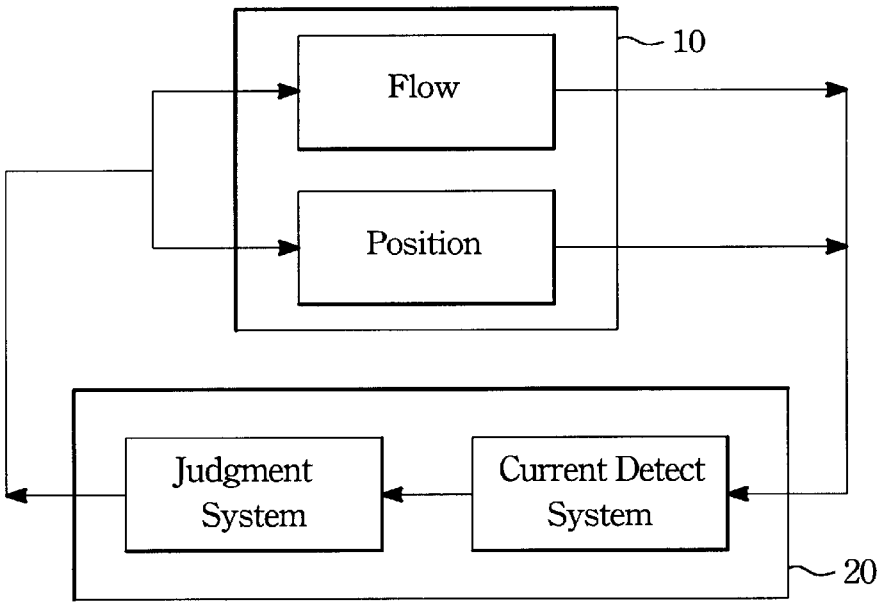
FIG. 2 shows a block diagram of an auto slurry deliver fine-tune system for chemical-mechanical-polishing process in accordance with the present invention.
Figure 3:
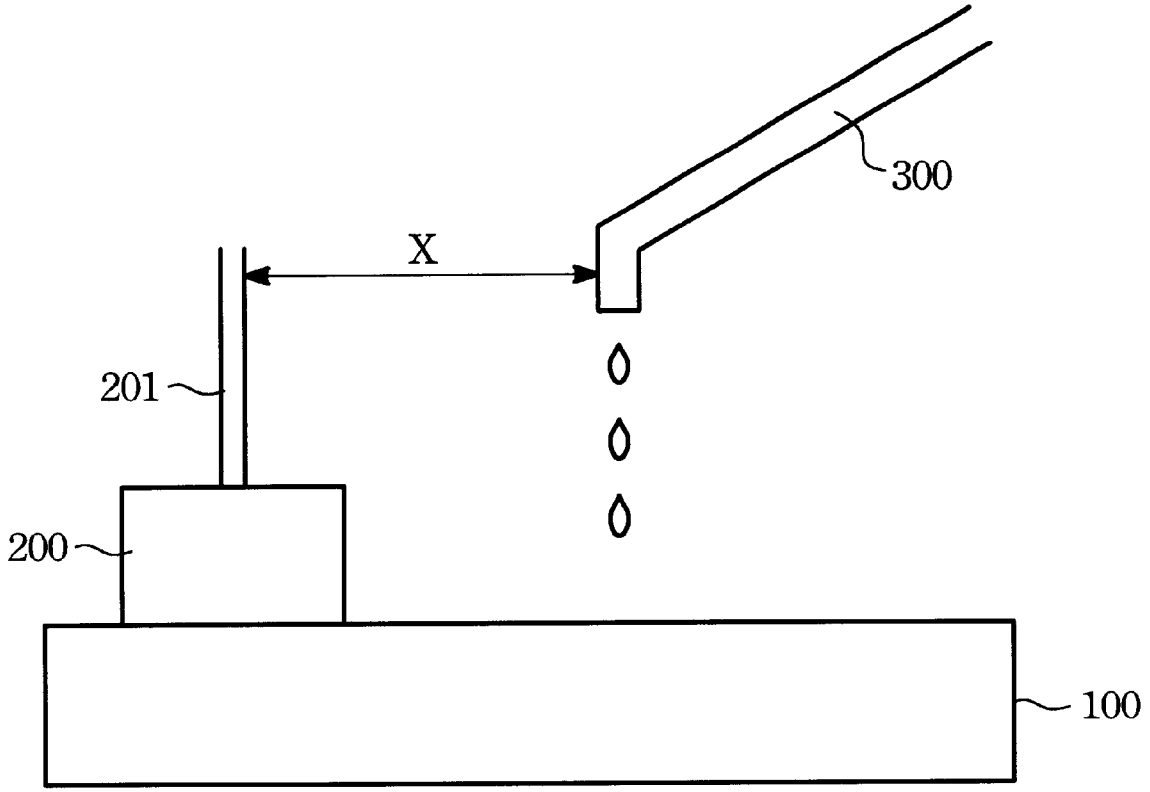
FIG. 3 shows a cross-section view of a conventional polishing pad, a polishing head put on the pad and a nozzle for injecting slurry put above the pad.

Referring to FIG. 2, a block diagram of an auto slurry deliver fine-tune system for chemical-mechanical-polishing (CMP) process is mentioned. Besides, the fine-tune system consists of a slurry flow system 10 and a control system 20.

Still referring to FIG. 2, the slurry flow system 10 controls the flow rate of the slurry that is dispersed on the polish pad of a CMP system and the distance between the slurry injector and the polish head of the CMP system to optima the flow of the slurry on the polish pad. Before the flow rate and the distance as described above are varied by using the slurry flow system 10, the rotated rate of the polish pad, the rotated rate of the polish head, the pressure on the polish head and the pressure on the wafer under the polish head are sustained as constant values for maintaining the process parameters of a CMP process performing in the CMP system.

Still referring to FIG. 2, the control system 20 consists of a current detect system and a judgement system. The current detect system detects the current for driving the turn-table of the CMP system and the turn table is adapted for rotating the polish pad of the CMP system. As the turn table is driven by a small current and rotates at a constant rate, it means that the friction between the wafer under the polish head and the polish pad is small.

The judgement system in the control system 20 receives the current value for determining whether the current is a minimum value. As the current is not a minimum value, the judgement system will change the flow rate of the slurry and the position of the slurry injector, which means the distance between the injector and the polish head, until the current reaches a minimum value.

Still referring to FIG. 2, the slurry flow system 10 varies a flow rate of the slurry in the CMP system and the distance between the slurry injector and the polish head of the CMP system. The current detect system detects the current driving the turn-table of the CMP system. The judgement system determines whether the current is minimum in order to determine that the flow rate and the distance are optima. Meanwhile, the slurry flow system varying the flow rate and the distance is sequentially to sustain the flow rate, to vary the distance and to vary the flow rate in order to get the minimum value of the current. Alternatively, the slurry flow system varying the flow rate and the distance is sequentially to sustain the distance, to vary the flow rate and to vary the distance in order to get the minimum value of the current. In the present invention, the current detect system detects the current driving the turn-table of the CMP system to determine the friction between the wafers under the polish head and the polish pad.

In a preferred embodiment of the present invention, when the current reaches minimum, the flow rate and the distance are optima, that means that the flow of the slurry is optima.

The present invention provides a method of fine tune a slurry deliver in a chemical mechanical polishing (CMP) system and this method will be described in the following descriptions. Firstly, a flow rate of the slurry in the CMP system and the distance between a slurry injector and a polish head of the CMP system are varied. Afterwards, the current driving the turn-table of the CMP system is detected and the judgement system determines whether the current is minimum. Finally, the flow rate and the distance are varied until the current reaches to minimum. Furthermore, after the current reaches minimum, the flow rate and the distance are sustained for the optima flow of the slurry.

In a preferred embodiment of the present invention, the flow rate and the distance are varied by sequentially sustaining the flow rate, varying the distance and varying the flow rate in order to get the minimum value of the current. Alternatively, the flow rate and the distance are varied by sequentially sustaining the distance, varying the flow rate and varying the distance in order to get the minimum value of the current.

According to the present invention, the current driving the turn-table of the CMP system is adapted to determine the friction between the wafers under the polish head and the polish pad. In other words, the current reaches minimum, as the flow rate and the distance are optima and the flow of the slurry is optima.

Figure 4:
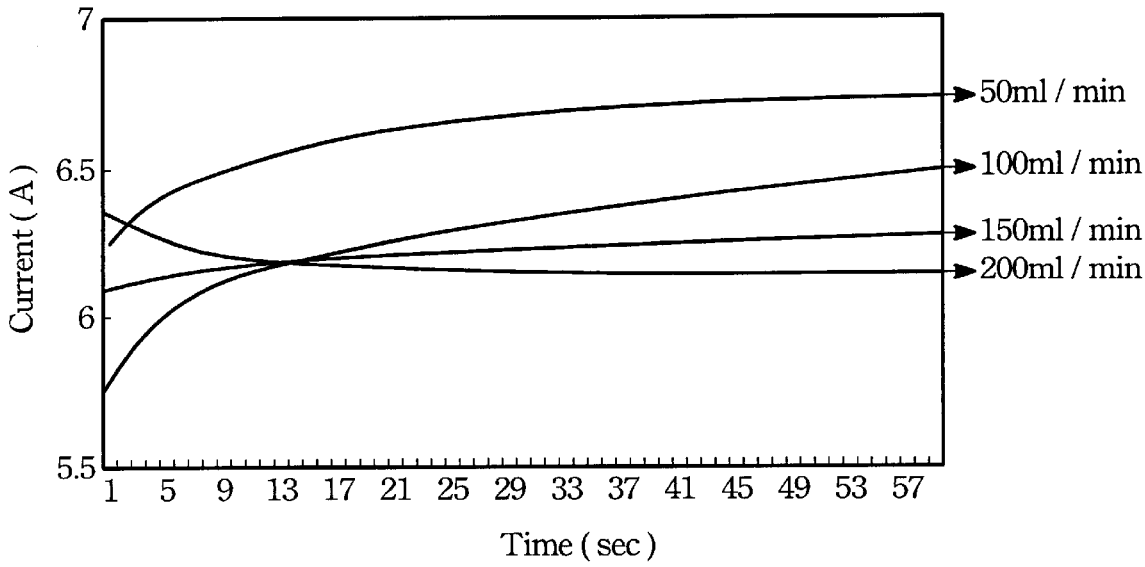
FIG. 4 shows the relationship of the turn-table current and the flow rate of the slurry in chemical-mechanical-polishing process that is controlled by the system in accordance with the present invention.

Referring to FIG. 4, the relationship of the turn-table current and the flow rate of the slurry in a CMP process that is controlled by the fine-tune system is shown. FIG. 4 shows four curves of the relationships between the flow rates and the current values. Moreover, the flow rates include 50 ml/min, 100 ml/min, 150 ml/min and 200 ml/min, and one flow rate is respect to one curve. According to FIG. 4, the current under the first flow rate is smaller than that under the second flow rate, as the first flow rate is larger than the second flow rate. FIG. 4 means that the flow rate of slurry dispersing on the polish pad of a CMP system can effect the current driving the turn table of the CMP system. In general, to increase the flow rate of the slurry dispersing on the polish pad would decrease the current driving the turn table that rotates with a constant rate. Thus, to find an optima flow rate of the slurry on the polish pad could have a minimum current for driving the turn table of the CMP system.

Figure 5:
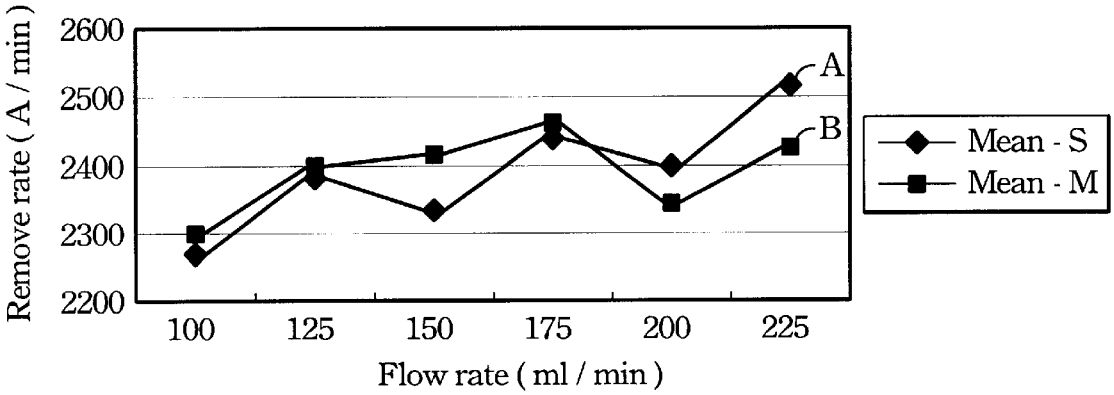
FIG. 5 shows the relationship of the remove rate and the flow rate of the slurry in chemical-mechanical-polishing process that is controlled by the system, before and after the position of the slurry injector is modified, in accordance with the present invention.

Referring to FIG. 5, the relationship of the remove rate and the flow rate of the slurry in a chemical-mechanical-polishing process that is controlled by the auto deliver slurry deliver fine-tune system, before and after the position of the slurry injector is modified, is demonstrated. In FIG. 5, the curve A and the curve B respectively indicates the relationship between the remove rate and the flow rate before and after the position of the slurry injector is modified. According to the two curve of FIG. 5, the position of the slurry injector being modified will increase the remove rate, when the flow rate of the slurry is smaller than 175 ml/min. FIG. 5 proves that the modification in the position of the slurry injector of a CMP system could improve the remove rate of the CMP system.

In sum, slurry flow rate is a key parameter of a CMP process, how to utility the slurry more efficiency is an important topic in CMP area. This system can monitor the slurry efficiency in-line, the slurry nozzle/flow can auto tune by the feedback current, no matter how the head/platen speed is, so use this system can fine tune slurry flow position more efficiency.

The conventional CMP system has a fixed slurry delivery system. If we fine tune platen speed, the head speed of the slurry layer on the pad will change. If we merely tune the flow rate of the slurry, it is hard to get an optimal solution. If the slurry flow position and flow rate can be automatically tuned by minimizing the turn table current, it is easy to monitor and modify the recipe.

The friction between the pad and wafer can influence the platen current, if the slurry flow is bad, the friction is large, so we can optima the slurry flow by analyze the feedback current, if we set a judge-method, the system can auto tune the slurry system by itself.

While the preferred embodiment of the invention has been illustrated and described, it will be appreciated that various changes can be made therein without departing from the spirit and scope of the invention.

What is claimed is:

1. A method of a slurry deliver fine tune in a chemical mechanical polishing (CMP) system, wherein the CMP system has a slurry flowing at a flow rate, a turn-table driven by a current, a slurry injector, and a polish head having a wafer thereunder, which method comprises:

varying a flow rate of the slurry in the CMP system and distance between the slurry injector and the polish head of the CMP system;

detecting the current driving the turn-table of the CMP system;

determining whether the current is minimum;

varying the flow rate and the distance to minimize the current; and sustaining the flow rate and the distance for optimizing the flowing of the slurry.

2. The method according to claim 1, wherein the flow rate and the distance are varied by sequentially sustaining the flow rate, varying the distance and varying the flow rate in order to minimize the current.

3. The method according to claim 1, wherein the flow rate and the distance are varied by sequentially sustaining the distance, varying the flow rate and varying the distance in order to minimize the current.

4. The method according to claim 1, wherein the current driving the turn-table of the CMP system is adapted to determine friction between the polish pad and the wafer under the polish head.

5. The method according to claim 1, wherein the current is minimized, as the flow rate and the distance are optimized and the flowing of the slurry is optimized.

* * * * *